United States Patent [19]

Dopera

[11] 3,931,753

[45] Jan. 13, 1976

[54] STRINGED MUSICAL INSTRUMENTS

[76] Inventor: Rudolph Dopera, 1410 Gaylord, Long Beach, Calif. 90813

[22] Filed: Aug. 5, 1974

[21] Appl. No.: 495,024

[52] U.S. Cl. ..... 84/296; 84/297

[51] Int. Cl.[2] ..... G10D 3/02

[58] Field of Search ..... 84/294, 266, 269, 411, 84/297 R, 299

[56] References Cited

UNITED STATES PATENTS

| | | | |
|---|---|---|---|
| 1,808,756 | 6/1931 | Beauchamp | 84/296 |
| 1,808,757 | 6/1931 | Beauchamp | 84/296 |
| 1,872,633 | 8/1932 | Dopyera | 84/296 |
| 2,029,469 | 2/1936 | Dopyera | 84/296 |
| 2,207,628 | 7/1940 | Miller | 84/299 |
| 3,435,721 | 4/1969 | Dopyera | 84/296 |

*Primary Examiner*—John F. Gonzales
*Attorney, Agent, or Firm*—Jones, Tullar & Cooper

[57] ABSTRACT

A stringed musical instrument is disclosed having a resonating diaphragm mounted within the instrument body and carrying a bridge assembly which supports the strings so that the diaphragm vibrates in accordance with string motion to produce an improved tone. The diaphragm is mounted within the instrument in a novel and improved manner to facilitate construction of the instrument, and an improved bridge assembly structure is disclosed. Means are provided to adjust the pressure of the strings on the bridge assembly to prevent damage to the diaphragm and to obtain an improved tone quality. The improved diaphragm support structure, bridge assembly and string pressure regulating means are adaptable to a variety of instrument types and shapes.

27 Claims, 12 Drawing Figures

FIG. 5
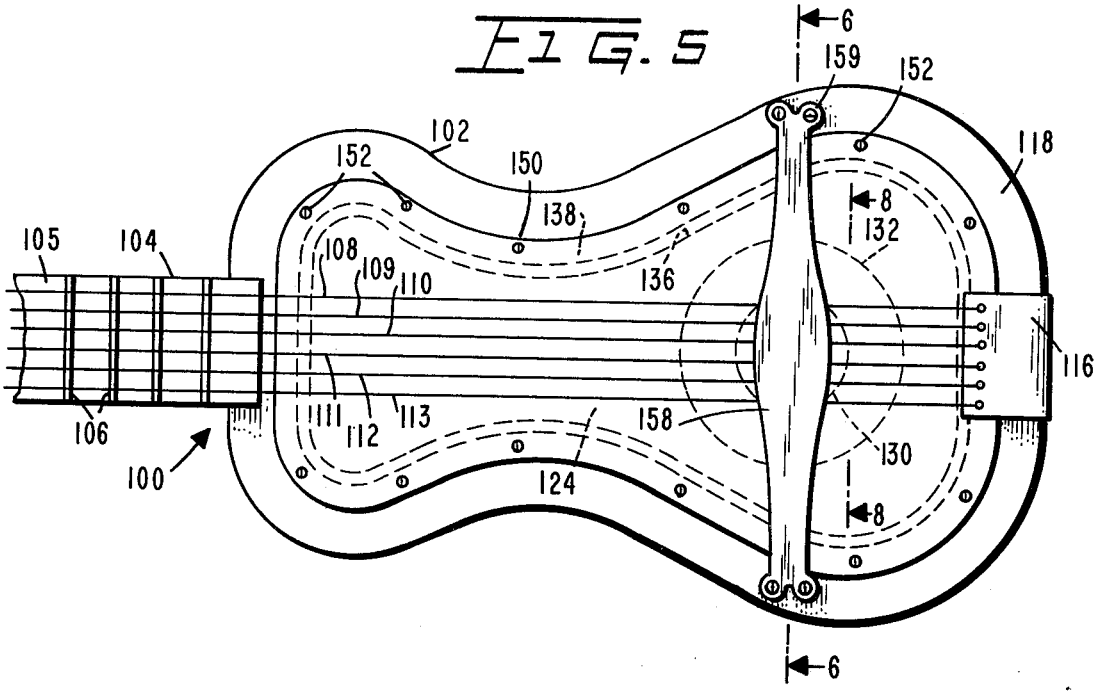
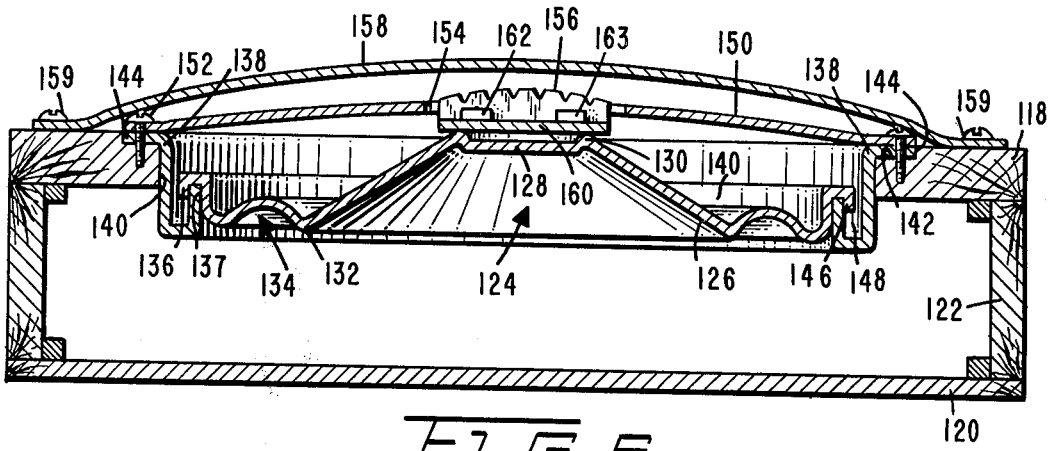
FIG. 6
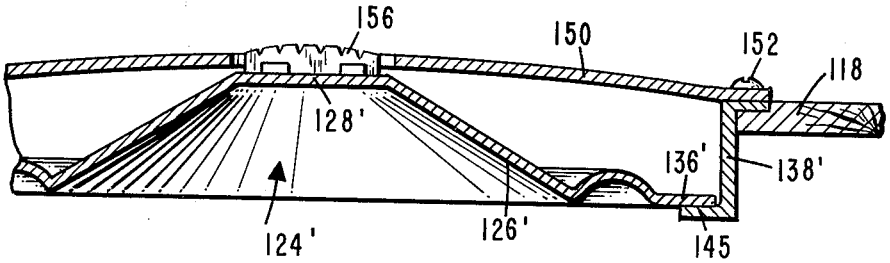
FIG. 6A

STRINGED MUSICAL INSTRUMENTS

BACKGROUND OF THE INVENTION

The present invention relates, in general, to musical instruments of novel design and construction, and more particularly to a new and improved instrument such as a guitar, banjo, mandolin, or the like.

Guitars and other stringed instruments of the ampliphonic or resophonic type, wherein the instrument's bridge is mounted on a shaped diaphragm located within the body of the instrument whereby the bridge causes the diaphragm to vibrate to provide increased amplitude, are well known and are disclosed, for example, in Pat. Nos. 2,045,265 and 3,435,721 issued to the inventor herein. As pointed out in those patents, the resonant diaphragm for such instruments generally is mounted within the instrument body on a supporting tone chamber which is secured to the housing, with the shape, size and material of the diaphragm and its mounting, the construction of the bridge assembly on which the strings rest, and the connection between the bridge and the diaphragm being critical factors in producing the proper and desired tone. The sound producing diaphragm in such instruments normally is protected by a cover secured to the top thereof, over which pass the strings and through which extends the bridge. The motion of the strings when the instrument is played is transmitted through the bridge to the diaphragm, which then vibrates to produce the desired tone.

Because of the criticality of the arrangement of parts in an ampliphonic instrument, it has been a difficult task to construct such an instrument and to secure the various parts in a relationship which insures that the desired tone can be produced in each instrument and maintained over a period of time. The mounting of the diaphragm in the instrument body has been accomplished in a number of ways in the past, but a delicate balance must be maintained between securing the diaphragm sufficiently to insure that it will not move, while yet permitting it to vibrate to produce the desired tone. Further, adjustment of string tension, and thus the pressure on the bridge, to insure maximum transfer of vibratory motion to the diaphragm has been a delicate task since tightening and loosening of the strings to tune the instrument varies the pressure on the bridge and changes this relationship. Thus, tuning of the instrument while retaining the desired sound has been difficult. The mounting of the bridge assembly on the diaphragm has also presented problems in that a firm contact must be maintained between the bridge and the diaphragm without dampening the vibrations transferred to the diaphragm, so that a clear sound is obtained.

SUMMARY OF THE INVENTION

Although prior instruments have performed well, it is nevertheless an object of the present invention to provide an improved structure and a method of assembling the resonant structure of an ampliphonic stringed instrument to provide a truer tone, better control of the tone, and an improved construction that provides a more positive assembly to insure a continuous tone quality.

It is a further object of the present invention to provide an improved musical instrument having a pleasing and novel appearance with an improved sound, wherein the sides of the instrument are removed and replaced by spaced support members to expose the resonant structure.

It is a further object of the present invention to provide an improved musical instrument construction and an improved method of effecting contact between the instrument bridge assembly and the resonant structure thereof to provide an improved tone quality.

It is a further object of the invention to provide an improved mounting structure for a bridge assembly whereby the transfer of sound vibrations from the strings of an instrument to a resonator mounted within the instrument is enhanced.

It is another object of the invention to provide better control of the quality and amplitude of sound from an ampliphonic string instrument by the provision of a pressure adjustment mechanism whereby the pressure of the strings against the bridge assembly may be accurately controlled.

Briefly, the present invention is directed to a stringed musical instrument such as a guitar, banjo, mandolin, or the like. The instrument of the invention is of the ampliphonic type having a resonator, or diaphragm, on which the strings rest by means of a suitable bridge arrangement to produce an amplified sound. In one form of the invention exemplified in the drawings, the diaphragm is mounted on a resonant cylinder, and the instrument body is substantially open-sided, exposing the cylinder. Suitable means are provided for securing the cylinder between the top and bottom of the instrument, with the resonant diaphragm fitting within the body portion and forming a closed top for the cylinder. Resting on suitable ridges formed in the diaphragm is a bridge assembly which includes a bridge support that may be in the form of an eight-armed "spider". The support carries at its upper portion a bridge insert which in the nature of a fret on which the strings of the instrument rest. Vibration of the strings as the instrument is played is transferred through the insert and through the spider to the diaphragm, which radiates the sound produced thereby.

In order to provide a better contact between the bridge assembly spider and the diaphragm, an improved construction is provided. The spider is formed with eight arms, in the usual fashion, but the tips of the arms are enlarged to provide a greater area of contact between the spider and the diaphragm, whereby the pressure is more evenly distributed, vibrations are better transferred, and the assembly is more resistant to damage that can be caused by excessive pressure on the strings or bridge.

In another form of the invention, such as may be exemplified by an ampliphonic type guitar having the usual closed sides, the diaphragm may be supported by a cylinder or in the alternative, by a suitable bracket secured to the top of the instrument. The bridge assembly may be a disk secured to the diaphragm and carrying a bridge insert which supports the strings.

Since the transfer of vibratory energy to the resonator is dependent upon the pressure of the strings on the bridge insert, means are provided to adjust this pressure. In one embodiment, this is accomplished by providing means for adjusting the string holder at the end of the instrument toward or away from the top board, thereby increasing or decreasing the pressure of the strings. In another form, this may be accomplished by means of a string lifter mounted adjacent the bridge insert. The lifter may be mounted on a string guard and located between the insert and the end of the instrument body.

As a result of the use of a string lifter, the bridge insert may be formed with a straight upper edge, thereby allowing a freer vibration of the strings than is possible with inserts that are notched to locate the strings. With the present arrangement, the lifter provides the proper string positioning, allowing the strings to freely vibrate on the bridge insert and thereby produce a better instrument tone.

In order to faciliate the assembly of ampliphonic instruments, the diaphragm of the present invention is provided with a flange arrangement around its periphery. This flange forms a downwardly facing peripheral channel which is adapted to engage a corresponding upwardly extending edge which may be formed either by a supporting resonant cylinder or by a suitable hanger or hangers secured to the instrument body. The cooperation between the downwardly turned flange on the diaphragm and the corresponding upwardly facing edge permits a positive engagement of the diaphragm which prevents it from shifting out of position and insures a true tone, as well as making assembly of the instrument simpler and more reliable. The improved method of mounting the diaphragm disclosed herein may be applied to variously shaped diaphragms for use in a variety of instruments.

BRIEF DESCRIPTION OF THE DRAWINGS

The foregoing and additional objects, features, and advantages of the present invention will become apparent from a consideration of the following description of preferred embodiments thereof, taken in conjunction with the accompanying drawings, in which:

FIG. 5 is a top plan view of another form of a stringed musical instrument utilizing the features of the present invention;

FIG. 6 is a cross-sectional view taken along line 6—6 of FIG. 5 and illustrating a modified form of the instrument construction;

FIG. 6A is a partial cross-sectional view of a modified form of the diaphragm structure of FIG. 6;

DESCRIPTION OF PREFERRED EMBODIMENTS

Figure 1:
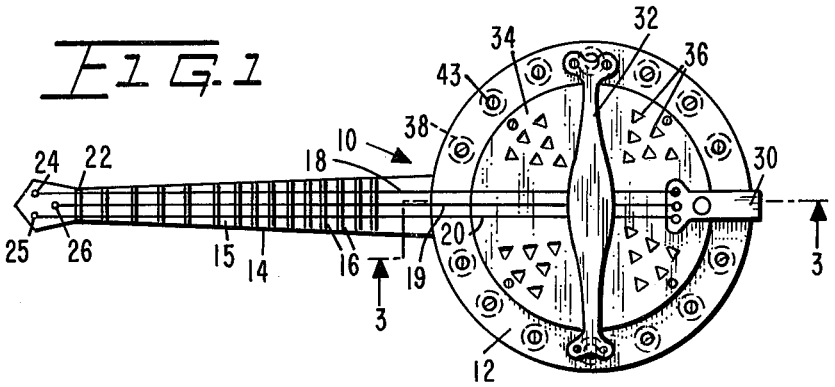
FIG. 1 is a top plan view of a new and novel stringed musical instrument incorporating the features of the present invention.

Turning now to a consideration of the drawings, there is illustrated in FIG. 1 a top plan view of a preferred form of the musical instrument of the stringed musical instrument of the present invention. This instrument, generally indicated at 10, has a body portion 12 which is generally circular in shape, in the manner of a banjo, but modified in accordance with the present invention to utilize a resonator arrangement of the general type known in ampliphonic instruments. The instrument is provided with a neck portion 14 having a fingerboard 15 carrying a plurality of frets 16 over which pass a plurality of strings such as the three strings 18, 19 and 20. At the free end of the neck the strings pass over a notched "nut" 22, which holds the strings in substantially parallel relationship and spaced from the fingerboard 15 by the desired distance, and are secured to corresponding capstans 24, 25 and 26 which permit the strings to be adjustably tightened to provide the proper tone, in accordance with the string weight, length and tension. The strings extend along the length of fingerboard 15, in known manner, and are supported by a bridge 28, to be described, which cooperates with the nut to space the strings the proper distance above the fingerboard. The ends of the strings are attached to a string holder 30, secured on the body portion 12, as will be described.

In a preferred embodiment of the invention, a bridge guard 32 is secured to the upper surface of the instrument body and arches over, or spans, the bridge 28 and the strings to prevent the instrument player's hands from resting on the bridge and muting or altering the tone of the instrument. As is known in ampliphonic stringed instruments, the resonator portion of the instrument is located within the body portion, and is covered and protected by a cover member 34 made of sheet material and secured to the upper surface of the instrument by suitable means such as screws. The cover member preferably is perforated, as indicated at 36, not only to improve the sound quality of the instrument, but to provide a decorative appearance.

Figure 2:
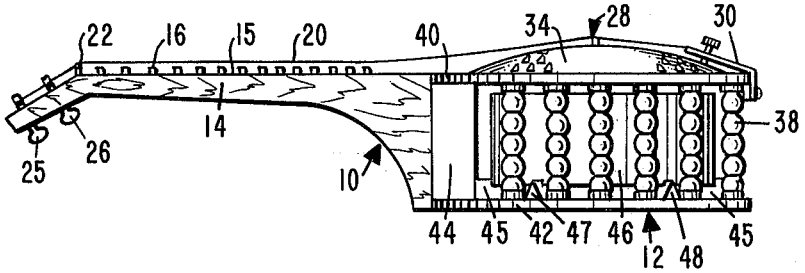
FIG. 2 is a side elevation view of the instrument of FIG. 1, illustrating the novel configuration of the instrument body.

Although the body portion 12 of the instrument 10 may be formed in conventional manner with continuous sidewalls and top and bottom boards enclosing the resonator device, the present invention contemplates a modification wherein the sidewalls are replaced by a plurality of decorative pillars 38, illustrated in FIG. 2 and shown in phantom in FIG. 1. As shown in these figures, the instrument incorporates a plurality of the pillars 38 spaced around the periphery thereof and secured between an upper board 40 and a lower board 42. The pillars 38 may take any desired shape in accordance with the decorative effect to be produced by the instrument, with the drawings illustrating a simple columnar design. The pillars are secured to the upper and lower boards by a suitable adhesive, by means of screws 43 countersunk in the top board, or by some other suitable securing means that will provide a strong, rigid construction. The holes in which the screws 43 are sunk may be filled with a suitable decorative material to form a part of the overall attractive appearance of the instrument. The neck portion 14 is secured to the body portion 12 of the instrument in conventional manner as by means of screws or other fasteners passing through a block 44 secured between the upper and lower boards 40 and 42. A support bar 45 extends across and is secured to the bottom board to provide reinforcement.

It will be noted that the FIG. 2 illustration does not include the bridge guard 32 in order to provide a clearer view of the manner in which the bridge 28 supports the strings 18–20.

As is conventional in ampliphonic musical stringed instruments of the type illustrated, for example, in U.S. Pat. No. 3,435,721, the instrument of FIGS. 1 and 2 incorporates a resonant cylinder 46 to provide a unique and desirable sound quality. This cylinder, which is preferably of extruded metal such as 10 or 12 guage aluminum formed into a hollow cylindrical shape, has an open bottom, carries on its upper, open end a vibratory diaphragm to be described, and is mounted in the instrument body in the manner illustrated in FIGS. 3 and 4. Although prior ampliphonic instruments have utilized resonant cylinders, the present invention incorporates a substantially open sidewall construction utilizing the pillars 38, which enable the cylinder to be visible, and thus to be a part of the attractive appearance of the instrument. To this end, the cylinder may be anodized to have various colors.

Figure 3:
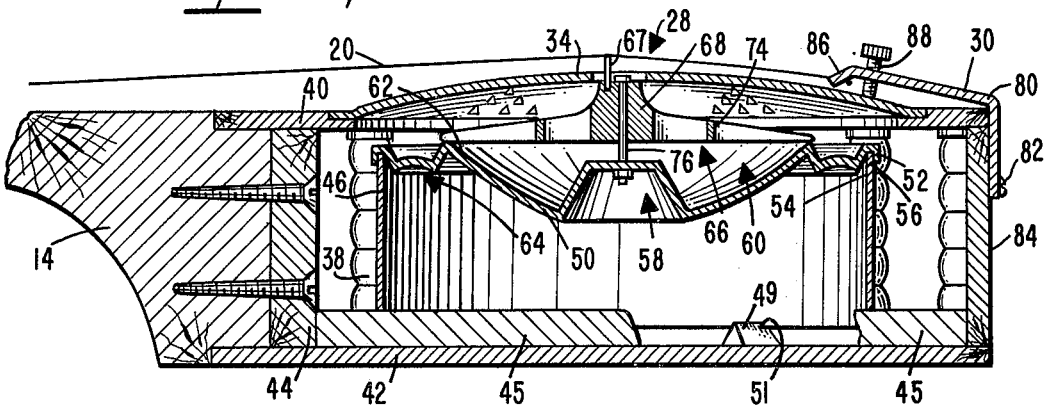
FIG. 3 is a cross-sectional view taken along line 3—3 of FIG. 1 and illustrating a preferred construction for that instrument.

As illustrated in FIG. 3, cylinder 46 may be supported on the bottom board 42 of the instrument 10 by means of a plurality of triangular blocks illustrated at 47, 48 and 49, which may be made of a suitable material such as wood or aluminum. Three support blocks spaced around the circumference of cylinder 46 are preferred, and these may be secured to the bottom board by screws, bolts, adhesives or other suitable fasteners. The bottom edge of the cylinder is formed with triangular notches at the locations of the blocks, as illustrated at 51 in FIG. 3, each notch fitting over and resting on the upper apex of its corresponding triangular block, whereby the cylinder is properly positioned on the bottom board. The bottom edge of the cylinder is also notched at diametrically opposed points to accomodate the support bar 45, the cylinder fitting over the bar as illustrated in FIG. 3. The pressure of the instrument strings on the bridge assembly holds the cylinder down against the support blocks and prevents displacement of the cylinder.

The top of cylinder 46 is closed by means of an imperforate diaphragm 50 having a peripheral flange 52 shaped to form a downwardly opening channel 54 adapted to receive the upper peripheral edge 56 of cylinder 46. Channel 54 is shaped to have a width only slightly larger than the thickness of the wall of the cylinder so that engagement of the channel and cylinder edge will securely hold the diaphragm and cylinder in assembled relationship, without the need for other fasteners. If desired, the channel may be crimped onto the edge of the cylinder, or a suitable adhesive, rivets, screws, or other fasteners may be used to insure that the edge of the diaphragm will be held securely on the cylinder and that the instrument will maintain a true tone.

The diaphragm illustrated in FIG. 3 is formed with a convex, generally conical central portion 58 surrounded by a curved concave portion 60. The concave portion of the diaphragm terminates in a peripheral ridge 62, which is connected to the flange 52 by means of a thin, flexible flex roll portion 64. As described in the said Pat. No. 3,435,721, the diaphragm is relatively thick and rigid at its center, and tapers in a radial direction to the thin flex roll portion.

Figure 11:
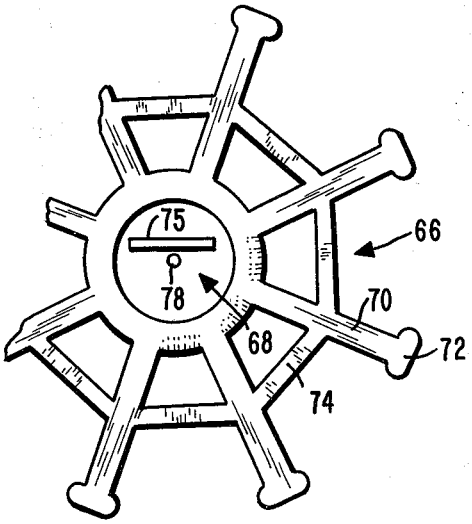
FIG. 11 is a partial top plan view of a modified bridge support for use in the present invention.

The bridge assembly 28 rests on and is supported by the diaphragm and serves to transfer vibrational energy from the instrument strings to the diaphragm. The assembly 28 consists of a bridge support member 66 which carries a thin rigid bridge insert 67. In a preferred form, the support member 66 is a modified version of the conventional spider, which may be of cast aluminum or similar material. The spider 66 includes a central hub 68 and a plurality of radially extending legs 70 (see FIG. 11) which terminate at enlarged pads 72. These pads are adapted to rest on, and provide improved contact with, the diaphragm ridge 62, the width of the pads serving to distribute the downward force of the spider to prevent crushing of the diaphragm ridge under the pressure created by the strings and by the player of the instrument. The spider includes a plurality of connector bars 74 which are spaced from the hub portion and which interconnect the radial arms 70 to provide rigidity to the spider, and thereby insure proper transfer of vibrations from the bridge insert to the diaphragm. The bridge insert 67 may be mounted on the spider by means of a groove 75 cast in the hub 68, by means of suitable adhesives, or both.

The bridge assembly 28 is secured to the resonator diaphragm by means of a bolt 76 which passes through a centrally located aperture 78 in hub portion 68 of the spider, and through a corresponding central aperture at the apex of the convex portion 58 of the diaphragm. The bolt is secured by a nut which is tightened sufficiently to hold the spider in firm contact with the diaphragm, without crushing the ridge portion 62.

It will be understood that the strings 18–20 of the instrument rest on the upper surface or crown of bridge insert 67, and that vibrations of the strings are transferred by the bridge insert to the spider and thence to the resonant diaphragm to transduce the mechanical vibrations of the strings into sound energy to provide the unique sound of an ampliphonic stringed instrument. The thickness and material of the diaphragm, as well as its exact shape, may be varied in accordance with the sound quality desired, as is known in this art, and as described in U.S. Pat. No. 3,435,721.

In the present invention, the bridge insert may be simply and easily constructed from a thin, flat, elongated member, such as that illustrated at 67, and may be metal, hardwood, plastic, bone, or other suitable rigid material. In one form of the invention, the insert may be provided with spaced, string-receiving notches along its upper surface, or crown, but in a preferred embodiment the crown is smooth, and spacing of the strings is accomplished by means of the string holder 30. By eliminating the usual notches in the bridge, the strings may move more freely to provide a freer, cleaner sound of a type that is particularly desirable in an ampliphonic type of instrument.

The string holder 30 allows the bridge member 28 to be securely fastened to the spider, while still providing the desired instrumental sound, since holder 30 is adjustable to permit control of the string pressure on the bridge. Although string pressure adjustments have in the past been made by adjusting the height of the string holder, this was accomplished by wedging shims of various thicknesses under the holder. Such a procedure was not only time-consuming, but was not a satisfactory way to adjust string pressure. In the present invention, the holder comprises a generally L-shaped lifter plate 80 made of a spring metal such as a hard brass. One leg of the plate is secured to the body portion 12 of the instrument, as by screws 82, either to one of the pillars 38 or to a rear block, or lifter support post 84, illustrated in FIG. 3 as being secured between the top and bottom boards 40, 42. The angle in the lifter plate is located at the edge of the body portion of the instrument so that the remaining leg of the plate extends toward bridge assemblies 28 and is generally parallel to the top board.

The forward end 86 of plate 80 is curved downwardly and provided with spaced slots or apertures (not shown) to receive and hold the ends of the strings so that the strings may be loosened or tightened by the corresponding capstans to adjust the tone of the instrument. The string holder plate is provided with an aperture spaced back from the forward end 86 and threaded to receive an adjustment screw 88, which passes through the holder plate. The end of the screw is rounded and abuts against the cover plate 34 or against the top board 40 to space the lifter plate from the top board. By advancing the screw into the lifter plate 80, the top leg thereof is moved away from the body 12, lifting the strings which are connected to it, and reducing the pressure of the strings on the bridge insert 67. Similarly, by retracting the screw out of plate 80, the spring action of the plate causes it to move back toward the body of the instrument, thereby increasing the pressure of the strings on the bridge. In this manner, the pressure of all of the strings may easily be adjusted at the same time by simply turning a single screw one way or the other to move the strings toward or away from the instrument body. This eliminates the problems and time consuming difficulty of prior art string pressure adjustments. Although not illustrated for purposes of clarity, the screw may be provided with a locking nut, such as a wing nut, which may be tightened against the upper surface of lifter plate 80 to prevent inadvertent movement of the screw.

Figure 4:
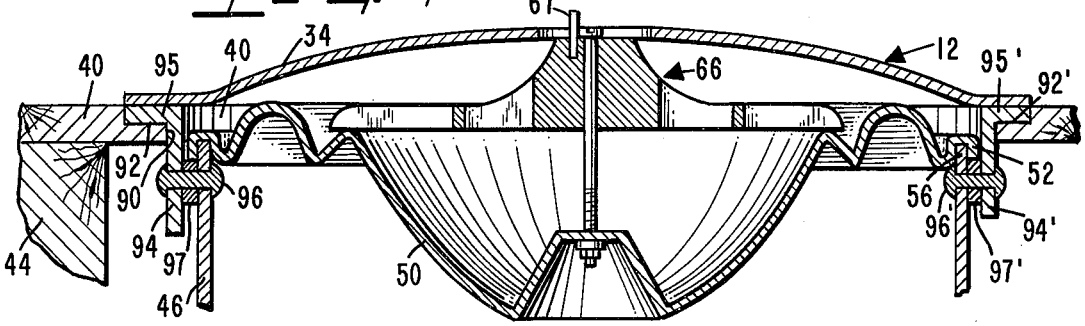
FIG. 4 is a cross-sectional view of a modified form of the instrument of FIG. 3.

A modified form of the instrument of FIGS. 1–3 is illustrated in FIG. 4, wherein elements corresponding to elements of FIGS. 1–3 are similarly numbered. The modified version of FIG. 4 is substantially identical to the version of the prior figures, and thus is shown only partially, and in cross-section, again along line 3—3 of FIG. 1. As may be seen, the modified instrument body portion 12 includes a top board 40, a cover 34, a cylinder 46, and a diaphragm 50 supporting a spider 66. However, in this version the resonant cylinder is supported from the top board 40 of the instrument, rather than being supported by the bottom board, to provide a different sound. The top board 40 is provided with an aperture 90, preferably circular, the inner periphery of which is shaped to form two or more insets or shoulders 92, 92′ which are spaced around the aperture and adapted to receive two or more corresponding support brackets or hangers 94, 94′. The brackets may be of steel, brass, or other suitable material, are shaped to depend downwardly through the aperature 90, and each incorporates an outwardly flared flange 95, 95′, which rests on a corresponding shoulder 92, 92′ to hold the brackets in the aperture. The brackets may be screwed, riveted, or otherwise secured to the top board to hold them firmly in place. The cover plate 34 fits over the flange portions of brackets 94 and 94′, and both the cover and the brackets may be held in place on the top board by the same fasteners (not shown).

The cylinder 46 is supported from each of the spaced brackets 94, 94′ by means of fasteners such as rivets 96, 96′, each of which passes through its corresponding bracket 94, 94′, a corresponding spacer washer 97, 97′, and the side wall of cylinder 46. The rivets or other fasteners provide a firm support for the cylinder and suspend it so that it hangs freely within the instrument body, spaced from the top, side, and bottom walls thereof. The cylinder is open at the bottom, with the bottom edge of the cylinder being spaced about one-fourth inch from the bottom board 42 and from the support bar 45, while the diaphragm 50 rests on, and is secured to, the upper peripheral edge 56 of the cylinder. As with the embodiment of FIGS. 1–3, the upper edge of the cylinder receives the channel-shaped peripheral flange 52 of the diaphragm, with a suitable adhesive or other fastener holding the diaphragm securely in place if desired. It will be noted that the diaphragm of FIG. 4 is shaped slightly differently than that of FIG. 3, illustrating the variations possible in instruments of this type to obtain different sounds.

Although the features of the invention are illustrated in combination with a generally circular instrument in FIGS. 1–4, it will be seen that these features are equally applicable to other ampliphonic instruments, such as the guitar illustrated at 100 in FIG. 5. In this embodiment, the instrument does not incorporate a resonant cylinder, but does utilize a diaphragm supported by the top board of the instrument and protected by a decorative cover plate.

Referring now to FIGS. 5 and 6, it will be seen that the instrument 100 includes a body portion 102 and a neck portion 104 having a fingerboard 105 and a plurality of spaced frets 106. The instrument carries a plurality of strings 108–113 which are secured at one end to corresponding capstans and at the other end to a string holder 116. The body portion of the instrument is formed from a top board 118, a bottom board 120, and a continuous side wall 122, and may be made of wood, with the joints being glued to form a strong structural unit. It will be understood that various other shapes may be provided, and that various suitable materials may be used.

The resonant diaphragm for the present embodiment is illustrated at 124 in the cross-sectional view of FIG. 6, with its outline being indicated in FIG. 5 by a dotted line. As seen, the resonator includes a central convex portion 126 having a flattened apex 128 defined by a circular ridge 130. Surrounding the conical central portion 126 and connected at its peripheral edge 132 is a flexible portion 134 which is generally convex and extends to a peripheral flange 136 which defines a downwardly facing channel 137 adjacent the outer edge of the resonator. As seen in FIG. 5, this outer edge of flange 136 generally follows the contours of the instrument, and in the illustrated form is generally in the shape of a guitar, although various other shapes may be provided in accordance with the particular instrument for which it is provided.

The resonator diaphragm is supported in the top board 118 of the instrument by means of a generally annular hanger, or bracket 138 which, in plan view as seen in phantom in FIG. 5, extends around the periphery of the diaphragm. The top board 118 of the guitar is formed with an aperture 140 which generally follows the outline of the instrument, and which is adapted to receive the resonator 124. The upper surface of the top board adjacent the aperture 140 is formed to provide a shoulder portion 142 which receives a flared flange portion 144 of the bracket 138 to thereby support the bracket. The bracket 138 follows the shape of the aperture 140, and extends downwardly through the aperture 140, as seen in FIG. 6. An upwardly turned lip 146 on the bracket defines an upwardly opening hanger channel 148 which also follows the shape of aperture 140. This channel is adapted to receive the outer flange portion 136 of the diaphragm 124, with the downwardly facing channel 137 formed at the periphery of the diaphragm snugly engaging the lip portion 146 of the hanger 138 to secure the diaphragm quickly, easily, and firmly to the instrument. If desired, the diaphragm may be further secured to the hanger by means of a suitable adhesive, by crimping the channel 137 onto the lip 146, or by other suitable fastening means. In some instrument configurations, it may be difficult to shape the bracket to include the lip portion 146. In such cases, the simplified bracket 138' shown in FIG. 6A may be used, with the outer edge 136 of the diaphragm being flat and resting on an inwardly projecting shoulder 145, as illustrated. The diaphragm may be secured to the bracket in any suitable manner.

The hanger and the diaphragm assembly are protected by a cover member 150 which preferably is of metal, and which also provides a decorative top surface for the instrument. The cover is secured to the top board by means of screws 152 or other fasteners which may be countersunk in the cover, and which pass through the flange portion 144 of the hanger 138 to also secure the hanger. The cover includes a central opening 154 (FIG. 6) through which a bridge insert 156 extends to receive and support the strings. The bridge is protected by an arched guard 158 secured to the top board 118 by means of fasteners 159. As with the prior embodiment of the invention, the guard protects the strings and the bridge by providing a place for the user of the instrument to rest his hand, thereby preventing excessive pressure on the bridge assembly and the resonant structure, preventing damage to the resonant structure, and insuring that a true sound is produced.

As explained above, the diaphragm is formed in known manner to provide the desired ampliphonic sound from the instrument. Typically, the diaphragm may be of plastic or metal, and formed with a relatively thick center portion and a decreasing thickness radially toward the outer edges. If the material used is a metal such as aluminum, the central portion may be 12 gauge, with the edges hammered or coined down to a thickness of about 0.012 inch at the flex roll portion (134 in FIG. 6) to provide the desired vibrational characteristics. The outer edge or flange portion of the diaphragm preferably is relatively thick to provide a solid base for securing the diaphragm to its hanger.

The length of the hangers 138, that is, the distance which they extend below the top board 118, depends upon the exact shape of the diaphragm. As noted above, the diaphragm may take many configurations, and the length of the hanger must be such that the bridge insert 156 extends above the surface of cover 150 sufficiently far to provide support for the strings.

Figure 7:
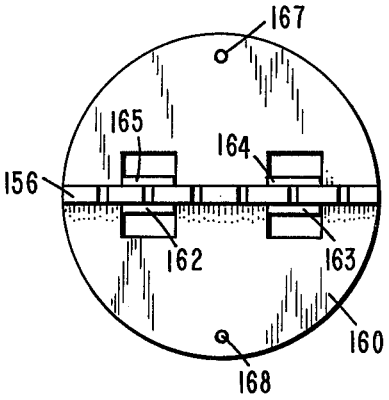
FIG. 7 is a top plan view of the bridge structure of FIGS. 5 and 6.

The diaphragm illustrated in FIG. 6 is of a shape which does not require the use of the spider type bridge support member illustrated in the embodiment of FIGS. 1–4 and 11. Instead, the transfer of vibrations from the strings to the diaphragm is accomplished by means of a bridge assembly which includes a flat, thin, metal support disk, or "cookie" 160, illustrated in top plan view in FIG. 7. The cookie rests on the ridge 130 of the diaphragm, and supports the bridge insert 156. In the form illustrated, the bridge insert 156 is secured on the bridge support disk 160 by means of a plurality of tabs or flaps 162–165 cut out of the disk and folded upwardly to form an insert-receiving channel. The bridge insert fits between the upstanding tabs, as shown in FIG. 7, and the tabs are crimped against the opposed sides thereof to secure the insert.

The disk 160 is affixed to the ridge 130 of the diaphragm by means of fasteners such as pop rivets or screws which are inserted through holes 167 and 168 in the disk, by an adhesive such as an epoxy glue, or by other suitable means to insure that the bridge and disk assembly provide a true path for transferring string vibrations to the diaphragm.

The construction of the diaphragm and bridge assembly combination may be greatly simplified, in accordance with a modified form of the invention as shown in FIG. 6A. In this embodiment, the shape of diaphragm 124' has been modified to eliminate the annular ridge 130 shown in FIG. 6, and to provide a flat upper surface 128' on the convex portion 126'. This flat surface is provided with cutout tab portions, two of which are shown at 162' and 163', which are folded upwardly to form a bridge-receiving channel in the manner described above with respect to the bridge support disk 160. The tabs so formed receive bridge insert 156 and may be crimped against it to secure it in place. This arrangement eliminates the need for disk 160, allows the bridge insert to be directly supported on the diaphragm to provide a direct transfer of sound vibrations from the strings to the diaphragm, and provides a simplified, and thus more economical, construction.

Although the crown of the bridge 156 is illustrated in FIGS. 6 and 6A as being slightly curved and as having spaced notches for receiving and positioning the strings, it will be apparent that the flat, smooth bridge crown structure illustrated in FIGS. 3 and 4 may be used, particularly where the adjustable string holder of those Figures also is used to provide the appropriate spacing and pressure of the strings. If desired, however, an alternate form of the string lifter may be used to regulate the pressure of the strings on the bridge assembly. This alternate form is illustrated in FIGS. 8, 9 and 10, to which reference is now made.

Figure 8:
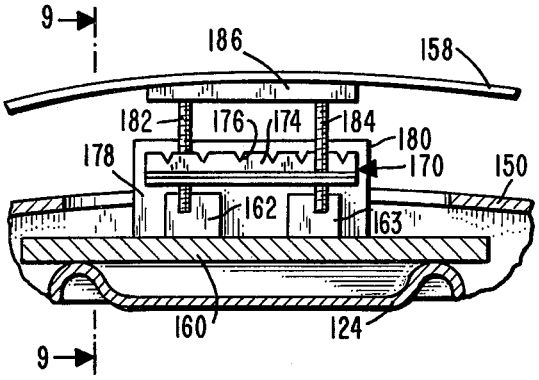
FIG. 8 is a view of a modified form of the bridge structure of the instrument of FIG. 5, illustrating a string lifter arrangement.
Figure 9:
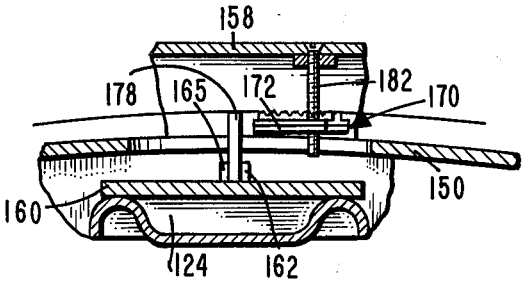
FIG. 9 is a side view of the modified string lifter, taken along lines 9—9 of FIG. 8.
Figure 10:
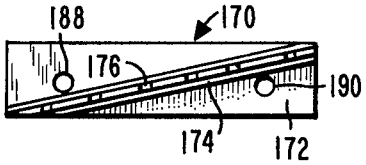
FIG. 10 is a top plan view of the string lifter of FIGS. 8 and 9.

In the form of the invention illustrated in FIGS. 8, 9 and 10, the pressure and spacing of the strings is controlled by means of an adjustable string lifter 170, which comprises a generally rectangular base 172 carrying an upstanding string guide 174. Guide 174 extends diagonally across the base 172, as seen in FIG. 10, and is provided with a plurality of spaced string-receiving notches 176 for holding the instrument strings in parallel relationship, and in the proper location on the instrument bridge assembly. As seen in FIGS. 8 and 9, the lifter 170 may be used in conjunction with a bridge insert 178 having a smooth, flat crown 180, whereby the strings may move freely on the bridge to provide an improved and sharper tone from the instrument. Bridge insert 178 may be secured in the disk 160 illustrated in FIGS. 6 and 7.

The adjustable string lifter 170 may be mounted, as in the preferred form illustrated in FIGS. 8 and 9, on the bridge guard 158 by means of a pair of adjustment screws 182 and 184. These screws are located in and turn freely in a pair of spaced apertures through the guard 158 and through a reinforcing block 186 secured as by soldering to the undersurface of the guard. The screws are received by and extend through a pair of corresponding threaded apertures 188 and 190, whereby rotation of the screws adjusts the spacing between the lifter 170 and the guard 158. Accordingly, when the instrument strings pass over the bridge and rest on the lifter, rotation of the screws 182 and 184 to raise or lower the lifter permits easy adjustment of string pressure on the bridge, thereby permitting optimum transfer of string vibration to the diaphragm.

Although the crown 180 of bridge insert 178 is shown as being flat, it will be understood that the particular shape will be determined by the type of instrument with which it is used. The flat bridge and corresponding flat lifter may be preferred for a Hawaiian type of guitar, whereas the crown may be curved as shown in FIG. 6 for use in a Spanish style guitar, which has a similarly curved fingerboard, in which case the string lifter would also be curved.

Thus there has been described a new and novel construction for stringed instruments such as guitars, banjos, and the like, particulary of the ampliphonic or resiphonic type utilizing a vibratory or resonant diaphragm within the instrument body. As has been described, the improvements in this type of instrument include the provision of a diaphragm having a downwardly facing channel formed at its peripheral edge by which the diaphragm can be firmly, yet easily, mounted within the instrument, and whereby the desired sharp, true tone qualities are retained in the instrument. The peripheral channel construction disclosed herein enables the diaphragm to be mounted within the instrument by means of a resonant cylinder which may be supported on the top or bottom board of the instrument as shown in FIGS. 3 and 4, respectively, or by means of hangers of the type illustrated in FIGS. 4 and 6.

Other features of the invention include the provision of new bridge assemblies which provide improved transfer of sound vibrations from the instrument strings to the resonant diaphragm. These new assemblies include an improved spider construction wherein the radial legs which contact the diaphragm are provided with enlarged pads which distribute the pressure exerted by the instrument strings, and thus prevent damage. The spider also may include a groove for receiving the bridge member, thereby providing improved transfer of sound. For diaphragms utilizing a cone construction, as illustrated in FIGS. 6 and 6A, modified assemblies may be used, wherein the bridge is mounted on a disk that does not utilize the radially extending legs of the spider construction or is mounted directly on the diaphragm. Where a disk is utilized, it is affixed to the diaphragm and in both cases means such as a plurality of upstanding tabs are provided to receive and secure the bridge member.

Additional features of the invention include means for easily and conveniently regulating the pressure of the strings against the bridge assembly to prevent excessive force on the diaphragm. In one embodiment, this regulation is provided by an adjustable string holder secured to the body of the instrument, and in another embodiment is provided by an adjustable lifter mounted on the transverse bridge guard. Although these various features have been described and illustrated in specific form in conjunction with specific instruments such as the novel balalaika, which is constructed without the conventional side walls, it will be apparent that numerous variations and modifications can be made in these features and in the instruments in which they are employed, without departing from the true spirit and scope of the invention as defined in the following claims.

What is claimed is:

1. A stringed muscial instrument of the ampliphonic type which includes:

a body portion having a top board and a bottom board, said top board having a central opening;

a neck portion attached to and extending from said body portion;

a string holder mounted on said body portion;

a plurality of strings each adjustably secured at one end to said neck, extending therealong and across said body portion, and affixed at the other end to said string holder;

an imperforate resonant diaphragm having a central vibratory portion and an edge portion incorporating a flange which defines a downwardly facing peripheral channel;

mounting means secured to said body portion for mounting said diaphragm within said body, said mounting means including a resonant cylinder having an upper edge adapted to engage said peripheral channel whereby said diaphragm is held firmly in place with said central portion being free to vibrate, the upper end of said cylinder being closed by said diaphragm and the lower end of said cylinder being open and spaced from said bottom board; and a bridge assembly mounted on said central portion of said diaphragm, said bridge assembly extending through said central opening in said top board and engaging said strings, whereby said strings rest on said bridge assembly to transfer sound vibrations to said diaphragm.

2. The ampliphonic musical instrument of claim 1, further including means for regulating the pressure of said strings on said bridge assembly.

3. The ampliphonic musical instrument of claim 2, wherein said means for regulating the pressure of said strings on said bridge assembly comprises an adjustable means for said string holder.

4. The ampliphonic musical instrument of claim 3, wherein said adjustable means for said string holder comprises a generally L-shaped lifter plate of spring metal secured to said body portion, extending toward said bridge assembly, and angled for urging said strings against said bridge assembly, and a threaded adjustment screw mounted in said lifter plate and adjustable to oppose the spring angle of said lifter plate for selectively reducing the pressure of said strings on said bridge assembly.

5. The ampliphonic musical instrument of claim 2, wherein said means for regulating the pressure of said strings on said bridge assembly comprises an adjustable string lifter mounted on said body portion and located adjacent said bridge.

6. The ampliphonic musical instrument of claim 5, wherein said string lifter comprises a string guide adapted to engage said strings and adjustment means for selectively raising and lowering said string guide to raise or lower said strings.

7. The ampliphonic musical instrument of claim 6, further including bridge guard means spanning said bridge assembly, and wherein said string guide is mounted by means of said adjustment means to said bridge guard.

8. The ampliphonic musical instrument of claim 1, wherein said body portion is formed with substantially open sides, whereby said cylinder is exposed.

9. The ampliphonic musical instrument of claim 8, wherein the sides of said body portion are formed by spaced pillars secured between said top and bottom boards.

10. The ampliphonic musical instrument of claim 1, wherein said bridge assembly comprises a bridge support, means for securing said bridge support to said diaphragm, and a bridge insert secured to said bridge support and having a crown portion engaging said strings, said bridge support comprising a spider having a plurality of radially extending legs each terminating in a pad, said pads being adapted to rest on said diaphragm.

11. The ampliphonic musical instrument of claim 10, further including string lifter means for regulating the pressure of said strings on said bridge assembly.

12. The ampliphonic musical instrument of claim 1, wherein said bridge assembly comprises a bridge support, means for securing said bridge support to said diaphragm, and a bridge insert secured to said bridge support and having a smooth crown portion engaging said strings whereby said strings are free to vibrate on said bridge insert, said instrument further including adjustable string lifter means for regulating the pressure of said strings on said bridge assembly, cover means for said central opening, and bridge guard means spanning said bridge assembly.

13. The ampliphonic musical instrument of claim 1, further including cover means for said central opening having an aperture through which said bridge assembly extends, and arched guard means spanning said bridge assembly and secured to said top board to protect said strings and bridge assembly.

14. The ampliphonic musical instrument of claim 1, further including means for supporting said cylinder for free vibration within said housing to produce a resonant sound.

15. The ampliphonic musical instrument of claim 14, wherein said means for supporting said cylinder comprises a plurality of spaced mounting blocks secured to said bottom board, each block having an apex contacting the lower edge of said cylinder to support said cylinder while allowing free vibration thereof.

16. The ampliphonic musical instrument of claim 14, wherein said means for supporting said cylinder comprises a plurality of spaced hangers secured between said top board and the top of said cylinder to support said cylinder while allowing free vibration thereof.

17. The ampliphonic musical instrument of claim 1, wherein said bridge assembly comprises tab means formed in said central portion of said diaphragm, and a bridge insert secured directly in contact with said diaphragm by said tab means, said bridge insert having a crown portion engaging said strings.

18. The ampliphonic musical instrument of claim 1, wherein said bridge assembly comprises a thin flat metallic disk secured to and in contact with said central portion of said diaphragm; a plurality of upstanding tabs formed in said disk; and a bridge insert secured in contact with said disk by said tab means, said bridge insert having a crown portion engaging said strings.

19. A stringed musical instrument of the ampliphonic type which incudes:

a body portion having a top board and a bottom board, said top board having a central opening;

a neck portion attached to and extending from said body portion;

a string holder mounted on said body portion;

a plurality of strings each adjustably secured at one end of said neck, extending therealong and across said body portion, and affixed at the other end to said string holder;

an imperforate resonant diaphragm having a central vibratory portion and an edge portion incorporating a flange which defines a downwardly facing peripheral channel;

mounting means secured to said body portion for mounting said diaphrgam within said body, said mounting means including means for engaging said peripheral channel whereby said diaphragm is held firmly in place with said central portion being free to vibrate, a bridge assembly mounted on said central portion of said diaphragm, said bridge assembly extending through said central opening in said top board and engaging said strings, whereby said strings rest on said bridge assembly to transfer sound vibrations to said diaphragm; and adjustable string lifter means mounted on said body portion adjacent said bridge assembly for regulating the pressure of said strings on said bridge assembly.

20. The ampliphonic musical instrument of claim 19, wherein said mounting means comprises hanger means having an upper, outwardly extending flange engaging said top board, said hanger means extending downwardly through said central opening and having at its lower end an inwardly and upwardly extending lip portion adapted to engage said peripheral diaphragm channel.

21. The ampliphonic musical instrument of claim 20, wherein said central opening and said hanger means generally conform to the shape of said instrument, and said instrument further includes cover means for said central opening.

22. The ampliphonic musical instrument of claim 20, wherein said body portion, central opening, and diaphragm means are generally in the shape of a guitar.

23. The ampliphonic musical instrument of claim 19, wherein said bridge assembly comprises a bridge support, means for securing said bridge support to said diaphragm, and a bridge insert secured to said bridge support and having a crown portion engaging said strings, said bridge support comprising a thin flat disk adapted to rest on said diaphragm, said disk including a plurality of upstanding tabs for receiving and securing said bridge insert.

24. The ampliphonic musical instrument of claim 19, wherein said bridge assembly comprises a bridge insert secured to the top surface of said central portion of said diaphragm, said insert having a crown portion engaging said strings, and wherein said central portion of said diaphragm is flat and includes a plurality of upstanding tabs for receiving and securing said insert.

25. The ampliphonic musical instrument of claim 19, wherein said string lifter comprises a string guide adapted to engage said strings, and adjustment means for selectively raising and lowering said string guide to raise or lower said strings.

26. The ampliphonic musical instrument of claim 25, further including bridge guard means spanning said bridge assembly, and wherein said string guide is mounted by means of said adjustment means to said bridge guard.

27. The ampliphonic musical instrument of claim 19, wherein said bridge assembly includes a bridge support, means for securing said bridge support to said diaphragm, and a bridge insert secured to said bridge support, said bridge support comprising a spider having a plurality of radially extending legs each terminating in a pad, said pads being adapted to rest on said diaphragm.

* * * * *